US010222758B2

(12) United States Patent
Graemiger

(10) Patent No.: US 10,222,758 B2
(45) Date of Patent: Mar. 5, 2019

(54) DEVICE FOR COUNTING AND DISPLAYING A TIME UNIT FRACTION

(71) Applicant: ROLEX SA, Geneva (CH)

(72) Inventor: Pierre-Alain Graemiger, Trélex (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/386,923

(22) Filed: Dec. 21, 2016

(65) Prior Publication Data

US 2017/0185046 A1 Jun. 29, 2017

(30) Foreign Application Priority Data

Dec. 23, 2015 (EP) ..... 15202597

(51) Int. Cl.
*G04F 7/08* (2006.01)

(52) U.S. Cl.
CPC ..... *G04F 7/0866* (2013.01); *G04F 7/088* (2013.01); *G04F 7/0814* (2013.01); *G04F 7/0819* (2013.01)

(58) Field of Classification Search
CPC .... G04F 7/0814; G04F 7/0819; G04F 7/0866; G04F 7/088
See application file for complete search history.

(56) References Cited

U.S. PATENT DOCUMENTS 5,122,995 A * 6/1992 Vuilleumier ..... G04F 7/08 368/102
6,567,345 B1 * 5/2003 Furukawa et al. ..... G04B 33/00 368/80
2004/0264303 A1 * 12/2004 Brida et al. ..... G04B 19/00 368/110
2005/0249043 A1 * 11/2005 Bobe et al. ..... G04F 7/00 368/101
2006/0215497 A1 * 9/2006 Schneider ..... G04B 19/24 368/35

(Continued)

FOREIGN PATENT DOCUMENTS

| | | | |
|---|---|---|---|
| CH | 704 775 | A2 | 10/2012 |
| EP | 1 024 416 | A2 | 8/2000 |
| EP | 1 475 681 | A1 | 11/2004 |

OTHER PUBLICATIONS

European Search Report and Written Opinion dated Jun. 6, 2016 issued in counterpart European application No. 15202597; w/ English partial translation and partial machine translation (16 pages).

*Primary Examiner* — Daniel P Wicklund
(74) *Attorney, Agent, or Firm* — Westerman, Hattori, Daniels & Adrian, LLP

(57) ABSTRACT

A device for counting a number of time unit fractions or a number of movement unit fractions of a mobile member (1; 6; A2), the device including (i) a first cam (1) having a first surface (10: (ii) a second surface (20), the second surface being an abutment surface; (iii) a mobile support (4) urged by a spring (R4); (iv) a mobile pawl (3) mounted on the support (4) and urged by a spring (R3) toward the first surface, the pawl (3) being adapted to cooperate with one or the other of the first and second surfaces (10, 20) according to the position of the support (4); and (v) a control system (80) adapted, in a first or non-counting state of the control system, to maintain the support in a first position and, in a second or counting state of the control system, to allow the movement of the support.

23 Claims, 5 Drawing Sheets

(56) References Cited

U.S. PATENT DOCUMENTS

| | | | | |
|---|---|---|---|---|
| 2007/0091727 | A1* | 4/2007 | Bonvin et al. | G04F 8/00 368/107 |
| 2008/0253235 | A1* | 10/2008 | Hiraga et al. | G04B 19/02 368/172 |
| 2008/0298178 | A1* | 12/2008 | Perret et al. | G04F 7/08 368/101 |
| 2012/0257480 | A1 | 10/2012 | Girardbille et al. | |
| 2013/0329531 | A1* | 12/2013 | Nguyen | G04B 19/20 368/37 |
| 2014/0355393 | A1* | 12/2014 | Graemiger | G04F 7/08 368/80 |
| 2014/0355394 | A1* | 12/2014 | Graemiger | G04F 7/08 368/80 |
| 2015/0016232 | A1* | 1/2015 | Graemiger | G04B 19/02 368/132 |

* cited by examiner

DEVICE FOR COUNTING AND DISPLAYING A TIME UNIT FRACTION

This application claims priority of European patent application No. EP 15202597.9 filed Dec. 23, 2015, which is hereby incorporated by reference herein in its entirety.

The invention concerns a device for counting a number of time unit fractions or a number of movement unit fractions of a member. It also concerns a timepiece movement including a device of this kind. It further concerns a timepiece, notably a wristwatch, including a device of this kind or a movement of this kind. It finally concerns a method of operating a device of this kind, a movement of this kind or a timepiece of this kind.

Patent application EP1024416 concerns a device that makes it possible to display fractions of a second of chronometered time only when the chronograph is stopped. This system employs an oscillator running at 2.5 Hz and a star-shaped snail that is fastened to a gear pivoting at a predetermined speed. In the embodiment illustrated in the application, the snail pivots at the rate of one revolution every ten seconds, and has ten arms each of which has five steps. An arm therefore corresponds to an angular movement completed in one second and an angular movement of a step in a fifth of a second. Time information is displayed by means of a pivoted rack that is interengaged with a member for displaying fractions of a second and can come into contact with one of the steps on one of the arms of the spiral. When the chronograph is stopped a follower of the rack is urged into contact with one of the arms of the spiral and is therefore positioned by one of the steps so as to display the time information. The accuracy of the display of fractions of a second is therefore determined by the number of steps of each of the arms of the snail, which must be chosen as a function of the frequency of the balance wheel. For example, for a display of tenths of a second and for an oscillator running at 5 Hz, the application teaches that the arms of the snail could each have ten steps. A configuration of this kind is not the optimum given the geometrical complexity of a cam of this kind, the accuracy of manufacture and assembly that it requires, and its inertia, which is liable to degrade the performance of an oscillator notably running at 5 Hz.

Patent application EP1475681 discloses a mechanism similar to that of the aforementioned document. The display on demand of fifths of a second is also provided by a single snail cam that here is distinguished by six arms each of which has ten steps. To this end, the snail is turned at the rate of one revolution every six seconds by an oscillator running at 2.5 Hz. The time information is also displayed by means of a pivoted rack that is interengaged with a member for displaying fractions of a second and can be urged into contact with one of the steps on one of the arms of the snail.

The patent application CH704775 discloses an indicator of thousandths of a second based on the same principle. The display on demand of thousandths of a second is also provided by a single snail cam that is kinematically linked to a counter of hundredths of a second. In this embodiment, the snail has ten arms each of which has ten steps. The time information is also displayed by means of a pivoted rack that is interengaged with a member for displaying fractions of a second and can be urged into contact with one of the steps on one of the arms of the snail.

Devices of this kind are implemented by way of a lever interengaged with a display member that is adapted to cooperate with a cam kinematically linked to the gear train carrying the time information or information derived from the time. A construction of this kind is not problem-free, notably if there is a high demultiplication ratio between the gear train and the display member, for example in the context of a device for displaying fractions of a second in which the information is conveyed by means of a seconds wheel of a finishing system of a basic movement or a counting wheel of a chronograph mechanism. In this situation, the cam may have a particularly complex profile with excessively close dimensional tolerances. Its dimensions, in particular its outside diameter, can moreover be too large with regard to the volume available for a device of this kind. There is also the risk of its inertia degrading the chronometric performance of the basic movement, notably for an oscillator running at a frequency of 4 Hz or above.

In each of the above devices the lever, and notably the lever follower, is adapted to make the display of fractions of a second possible by cooperating with a cam, notably by cooperating through contact with a cam. Accordingly, in a first or counting state of devices of this kind the lever follower is in contact with the cam, notably in contact with one of the arms of the cam, in particular in contact with one of the steps of an arm of the cam. In a second or non-counting state of devices of this kind the lever follower is out of the reach of the cam and is not intended to cooperate with any other element.

In each of the above devices the lever, and notably the lever follower, provided to make the display of fractions of a second possible in cooperation with the cam pivots about a single pivot axis. There exist levers with a follower which has at least one degree of freedom relative to the lever. To be more specific, there exist levers the follower of which is mounted to rotate about at least two pivot axes. For example, the patent application EP2784603 discloses a lever of this kind that is mobile in rotation and to which is pivoted a spiral cam follower the angular position of which is defined by a return spring in one piece with the lever. This follower is adapted to cooperate with a spiral cam. However, the follower is caused to pivot about its rotation axis by the rotation of the spiral cam and not by the rotation of the lever.

The object of the invention is to provide a counting device making it possible to remedy the disadvantages referred to above and to improve the known prior art counting devices. In particular, the invention proposes a simple and reliable device for counting a number of time unit fractions or a number of movement unit fractions of a mobile member.

A counting device according to the invention is defined by point 1 as follows:

1. A device for counting a number of time unit fractions or a number of movement unit fractions of a mobile member, the device comprising:
   - a first cam having a first surface;
   - a second surface, the second surface being an abutment surface;
   - a mobile support urged by a spring;
   - a mobile pawl mounted on the support and urged by a spring toward the first surface, the pawl being adapted to cooperate with one or the other of the first and second surfaces according to the position of the support; and
   - a control system adapted, in a first non-counting state of the control system, to maintain the support in a first position and, in a second counting state of the control system, to allow the movement of the support.

Various embodiments of the counting device are defined by the points 2 to 13 as follows:

2. A device as defined in the preceding point, wherein the first surface of the cam includes n first recesses adapted to cooperate with the pawl in the counting state of the control system.
3. A device as defined in either one of the preceding points, comprising a second cam, notably a second cam fixed relative to a frame, including m second recesses adapted to cooperate, notably to cooperate through contact, with the pawl in the counting state of the control system.
4. A device as defined in the preceding point, wherein the second cam includes a toothset, in particular a toothed portion, the teeth of which define the second recesses.
5. A device as defined in the preceding point, wherein the first cam and the toothset are coaxial and/or the first surface is an external surface of the first cam and the radius of the first surface is greater than or equal to the total outside radius of the toothset and/or the first surface is an inside surface of the first cam and the inside radius of the first surface is less than or equal to the total inside radius of the toothset.
6. A device as defined in any one of the preceding points, wherein the first recesses are adapted, in the counting state of the control system, to allow the immobilization of the mobile support, notably through the cooperation by contact of the pawl with a second recess aligned with a first recess.
7. A device as defined in any one of the preceding points, wherein the first cam is a wheel pivoted on the frame.
8. A device as defined in any one of the preceding points, wherein the mobile support pivots on the frame, notably coaxially with the first cam.
9. A device as defined in any one of the preceding points, wherein the cam includes the second surface, the second surface being circular or substantially circular, for example.
10. A device as defined in any one of the preceding points, wherein the first surface and the second surface are coaxial and/or the first surface is an outside surface of the first cam and the radius of the first surface is less than the outside radius of the second surface and/or the first surface is an inside surface of the first cam and the inside radius of the first surface is greater than the inside radius of the second surface.
11. A device as defined in any one of the preceding points, wherein the angle subtended by a first recess is greater than or equal to the angle subtended by a second recess defined by the pitch of the toothset.
12. A device as defined in any one of the preceding points, wherein the control system includes a lever and a control member, notably a control member having a binary profile like a column wheel, the lever and the control member being adapted to cooperate with one another in order for the lever to be in the first non-counting state corresponding to a predefined position of the support in which the pawl cooperates with the second surface and the second counting state allowing any position of the support in which the pawl cooperates obstacle-wise with one of the first or second recesses.
13. A device as defined in any one of the preceding points, including a display member kinematically linked to the support, the support including for example a first toothed sector meshing with a second toothed sector on the display member, the display member including for example a pointer cooperating with a limb.

A movement according to the invention is defined by point 14 as follows:

14. A timepiece movement including a device as defined in any one of points 1 to 13.

A timepiece according to the invention is defined by point 15 as follows:

15. A timepiece, in particular a wristwatch, including a device as defined in any one of points 1 to 13 or a movement as defined in the preceding points.

The appended drawings show by way of example a number of embodiments of a timepiece according to the invention.

Figure 1:
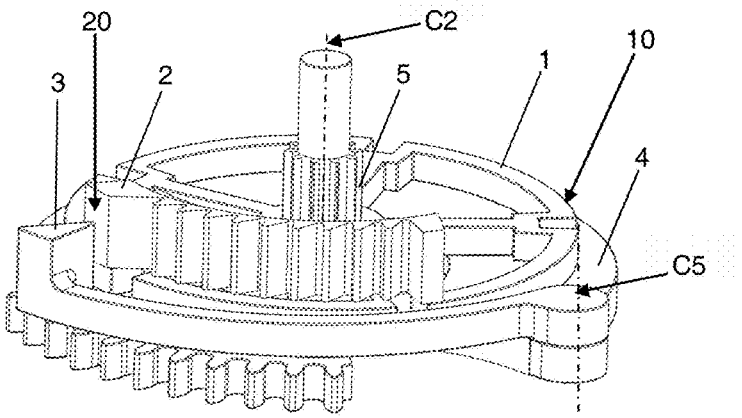
FIGS. 1 to 9 represent a first embodiment of a counting device according to the invention and a first embodiment of a timepiece according to the invention.

A first embodiment of a timepiece 120 is described hereinafter with reference to FIGS. 1 to 9. The timepiece is for example a wristwatch. The timepiece includes a first embodiment of a movement 110 according to the invention. The movement is preferably a mechanical movement. The movement preferably includes a module making it possible to display memorized or chronometered time information. The module is for example a chronograph module. In the example shown, the module is configured to make it possible to count time information to the nearest tenth of a second and to make it possible to display time information to the nearest tenth of a second. In the example described, the time information is a time chronometered to the nearest tenth of a second by the chronograph module when the latter is in the state memorizing the chronometered time.

To this end, the movement includes a first embodiment of a device 100 for counting a number of time unit fractions or a number of movement unit fractions of a mobile member. The device 100 advantageously also makes it possible to display the number of time unit fractions or the number of movement unit fractions of a mobile member.

The device 100 makes it possible to count a number of time unit fractions by counting a number of movement unit fractions of a mobile member 1, 6, A2. In the first embodiment described, the mobile member is for example a seconds mobile 6 of the chronograph module or a seconds indicator A2 added to the seconds mobile, like a seconds hand. The mobile member may also advantageously be a member 1 meshing with the seconds mobile.

In the first embodiment, the member is a first cam 1 that has a first surface 10.

The counting device includes this first cam 1. It further includes:

- an abutment second surface 20;
- a mobile support 4 urged by a spring R4;
- a mobile pawl 3 mounted on the support 4 and urged by a spring R3 toward the first surface 10, the pawl 3 being adapted to cooperate with one or the other of the first and second surfaces 10, 20 according to the position of the support 4; and
- a control system 80 adapted, in a first or non-counting state of the control system, to maintain the support in a first position and, in a second or counting state of the control system, to allow movement of the support.

The module making it possible to memorize time information includes for example a seconds wheel 6 pivoted about an axis C1 on a frame 99. An indicator A2, for example a pointer, is preferably fixed to this seconds wheel. The indicator may cooperate with a limb that is not represented to indicate seconds information.

The seconds wheel 6 has a toothset enabling it to mesh with a gear 5. This gear 5 is fastened or fixed to the first cam 1. The gear and the first cam pivot on the frame 99 about an axis C2. The mobile support 4 also pivots on the frame 99 about the axis C2. The mobile support 4 therefore pivots coaxially with the first cam 1. However, the support 4 is able to turn about the axis C2 independently of the gear 5 and the first cam 1. The support 4 is urged toward a rest position by a spring R4.

A second cam 2 is fixed to the frame.

The pawl pivots on the support about an axis C5. A return spring R3 urges the pawl against the first and second cams.

The support 4 has a toothset, notably a toothed sector, enabling it to mesh with a wheel or a rack 7 pivoting on the frame 99 about an axis C3. An indicator A1, for example a pointer, is preferably fixed to this wheel or rack. The indicator A1 preferably cooperates with a limb to indicate tenths of a second information.

The control system 80 includes a control member 8 pivoting on the frame 99 about an axis C4 and a lever 14 pivoting on the frame 99 about an axis C6. A first end of the lever 14 is adapted to cooperate with the support 4 and a second end 14*a* of the lever 14 is adapted to cooperate with the control member 8. The control system further includes a control lever 81 and a jumper 82 for indexing the control member.

The first cam 1 has a first cam surface 10. This first surface is of globally circular cylinder shape. However, this surface includes n first recesses 10*a* adapted to cooperate with the pawl 3 when the device, in particular the control system, is in a counting state. The first recesses have U-shaped or V-shaped sections, for example.

The n first recesses 10*a* are advantageously regularly distributed over the first surface 10.

The n first recesses 10*a* are such that, in the counting state, one of the recesses allows the positioning of a beak of the pawl at the level of a radius less than the outside radius of the first surface 10 of the first cam 1. Accordingly, in this configuration, and in cooperation with another element, the pawl 3 makes it possible to immobilize the mobile support 4.

It is seen that the geometry of the cam 1 is particularly simple. The recesses or notches 10*a* are provided here only to determine the relative angular position of the gear 5 and the mobile 6. The cam 1 is therefore particularly compact, easy to fabricate and to assemble within tolerances compatible with industrial means. The first cam 1 may advantageously be fabricated by electroforming, for example from an Ni alloy or an NiP alloy.

The second cam 2, which is immobile relative to the frame 99 of the movement, may for example be made in one piece with a blank of the movement, such as a chronograph bridge or plate.

For its part, the second cam 2 has m second recesses 20*a* adapted to cooperate, notably to cooperate by contact, with the pawl 3 in the counting state of the device or of the control system. The m second recesses 20*a* of the second cam 2 can constitute a toothset 2, in particular a toothed portion 2, the teeth of which may have a triangular or substantially triangular profile, for example. The profile may notably be asymmetrical and feature a steep first flank and a second flank having a slope significantly different from that of the first flank. The profile can therefore be a Breguet tooth profile, for example.

In a counting state of the device, the pawl is moved until it cooperates by contact with one of the second recesses. In particular, this cooperation is preferably achieved through contact of the pawl, in particular of a beak 30 of the pawl, against a steep flank of a second recess. This configuration of contact of the pawl with one of the second recesses determines a particular position of the support relative to the frame 99.

The second recess 20*a* with which the pawl cooperates is defined by a first recess 10*a*. In fact, this is a first recess 10*a* that allows the pawl to cooperate with one or the other of the two recesses. Accordingly, the geometry of the first recesses 10*a* is in no way involved in the precise positioning of the support relative to the frame, this being the function of the recesses 20*a* of the second cam 2.

The first cam 1 and the second cam 2 are advantageously coaxial. The first surface 10 may be an outside surface 10 of the first cam and the radius R10 of the first surface 10 may be greater than or equal to the total outside radius R20 of the toothset 2.

Alternatively, the first surface may be an inside surface of the first cam and the inside radius of the first surface may be less than or equal to the total inside radius of the toothset.

Moreover, the device includes a second abutment surface 20. This second abutment surface 20 is advantageously a portion of the second cam. In a non-counting state of the device, the pawl, notably the beak 30 of the pawl, rests against this second or abutment surface. The pawl is therefore prevented from cooperating with the first surface and notably the first recesses. The abutment therefore makes it possible to hold the pawl away from the first recesses.

The first cam 1 and the second surface 20 are advantageously coaxial. The first surface 10 may be an outside surface of the first cam and the radius R10 of the first surface 10 may be less than the outside radius R200 of the second surface 20. Alternatively, the first surface may be an inside surface of the first cam and the inside radius of the first surface may be greater than the inside radius of the second surface.

In the first embodiment represented, the gear 5 and the cam 1 are turned at the rate of twelve revolutions per minute by the mobile 6, which turns at the rate of one revolution per minute. The cam 1 has five notches 10*a* regularly distributed at the outside periphery 10 of the first cam 1. The second cam 2 includes two recesses 20*a*. The device represented therefore makes it possible to count and to display tenths of a second of memorized time information.

As will emerge hereinafter, the immobilization of the support in the counting state is made possible by the cooperation of a second recess with the pawl. The second recess that cooperates with the pawl is determined by a first recess that comes to face the second recess and therefore allows the pawl to cooperate with the second recess. To this end, the angle subtended by a first recess 10*a* is greater than or equal to the angle subtended by a second recess 20*a*, i.e. greater than or equal to the angle subtended by one pitch of the toothset 2.

Moreover, the angle subtended by the toothset 2, i.e. the angle subtended by all the second recesses, is equal or substantially equal to the angular amplitude between two consecutive first recesses.

As stated above, the pawl pivots on the support about an axis C5 and is urged toward a rest position by a spring R3.

In a variant embodiment, the pawl may be made in one piece with the spring and/or the support or be integrated with the spring and/or the support. The force urging the pawl into its rest position is then produced by elastic deformation of the pawl.

In a non-counting state of the device the pawl 3, in particular the beak 30 of the pawl 3, is therefore urged against the second abutment surface and in a counting state of the device the pawl 3, in particular the beak 30 of the pawl 3, is therefore urged toward the first cam 1 and the toothset 2.

The beak 30 of the pawl advantageously has a triangular or substantially triangular profile. The profile may notably be asymmetrical and feature a steep first flank and a second flank having a slope significantly different from that of the first flank. The steep flank of the beak is preferably adapted to cooperate with a steep flank of a second recess. It is also preferable if the profile of the beak 30 and the profile of the second recesses are complementary or substantially complementary.

The device 100 includes a display member 7, A1 kinematically linked to the support. The support includes, for example, a first toothed sector 40 meshing with a second toothed sector 70 of the display member. The display member includes an indicator A1, for example. The movement of the support relative to the frame therefore involves a movement of the indicator A1 relative to the frame to allow display of tenths of a second.

The indicator A1 is for example a tenth of a second pointer cooperating with a limb. The latter may be appended to a second indicator A2 that is interengaged with the seconds mobile 6.

Figure 2:
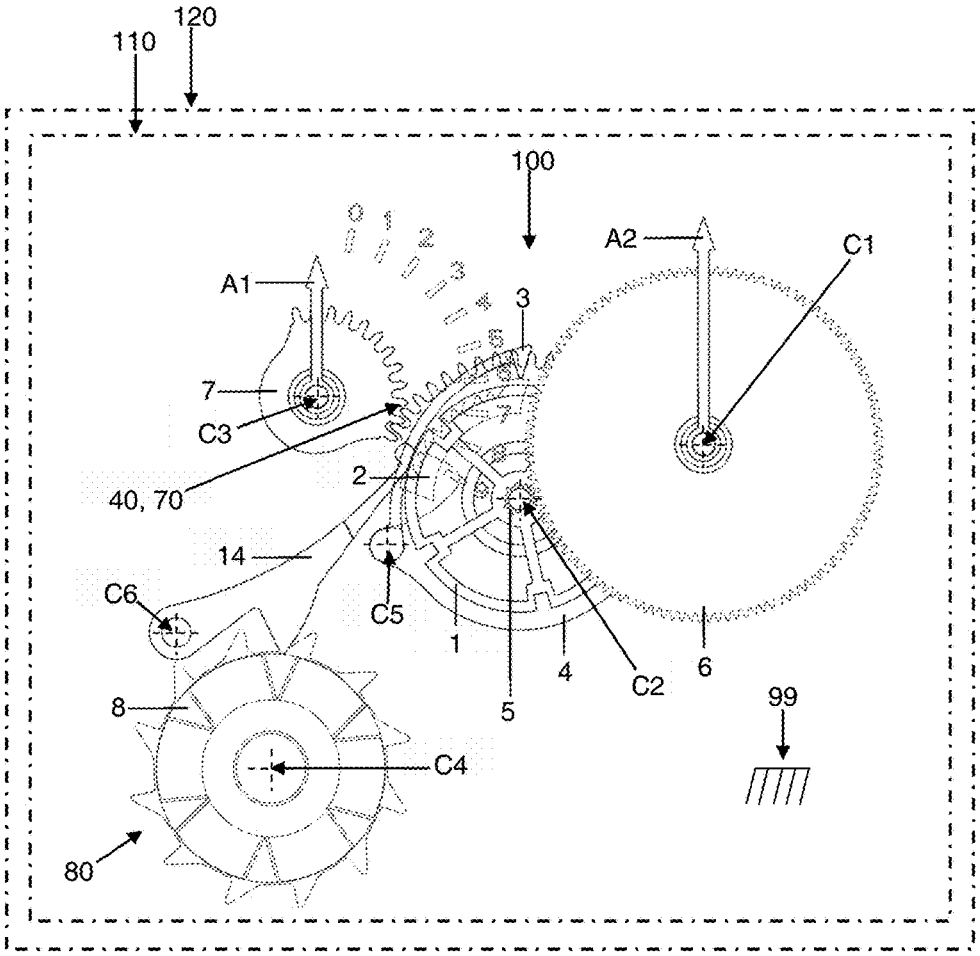
Figure 3:
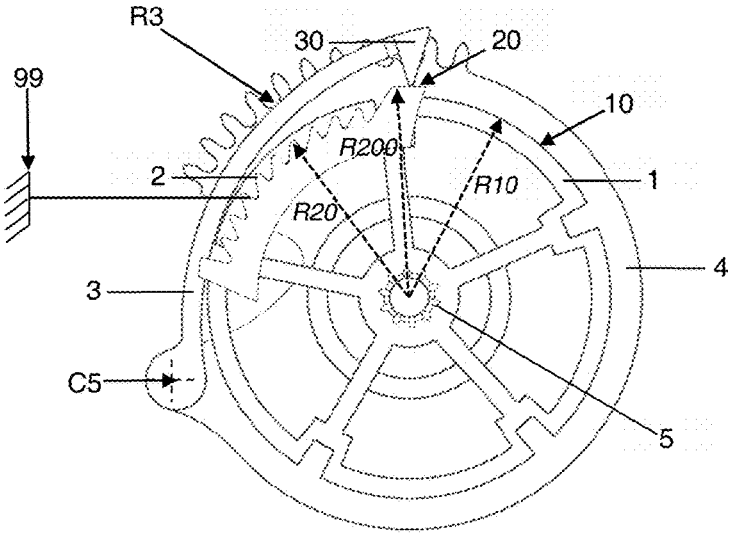

In a non-counting state of the device represented in FIG. 2 the indicator A1 preferably does not indicate any information. To this end, the pointer A1 can point outside the limb representing tenths of a second, for example.

The second recesses are advantageously such that the tenths of a second indicator A1 comes to be positioned exactly facing the tenths of a second indications on the limb. Accordingly, in the first embodiment described, the indicator A1 can occupy only ten distinct positions. The second recesses are preferably such that the device 100 displays X tenths of a second for any memorized time information T expressed in seconds and such that:

$Y+X\times0.1-0.05\leq T<Y+X\times0.1+0.05$ where X and Y are natural integers and $X\in[0; 9]$ and Y are the number of complete seconds of the information T.

Alternatively, the second recesses are such that the device 100 displays X tenths of a second for any memorized time information T expressed in seconds and such that:

$Y+X\times0.1\leq T<Y+(X+1)\times0.1$ where X and Y are natural integers and $X\in[0; 9]$ and Y are the number of complete seconds of the information T.

Figure 4:
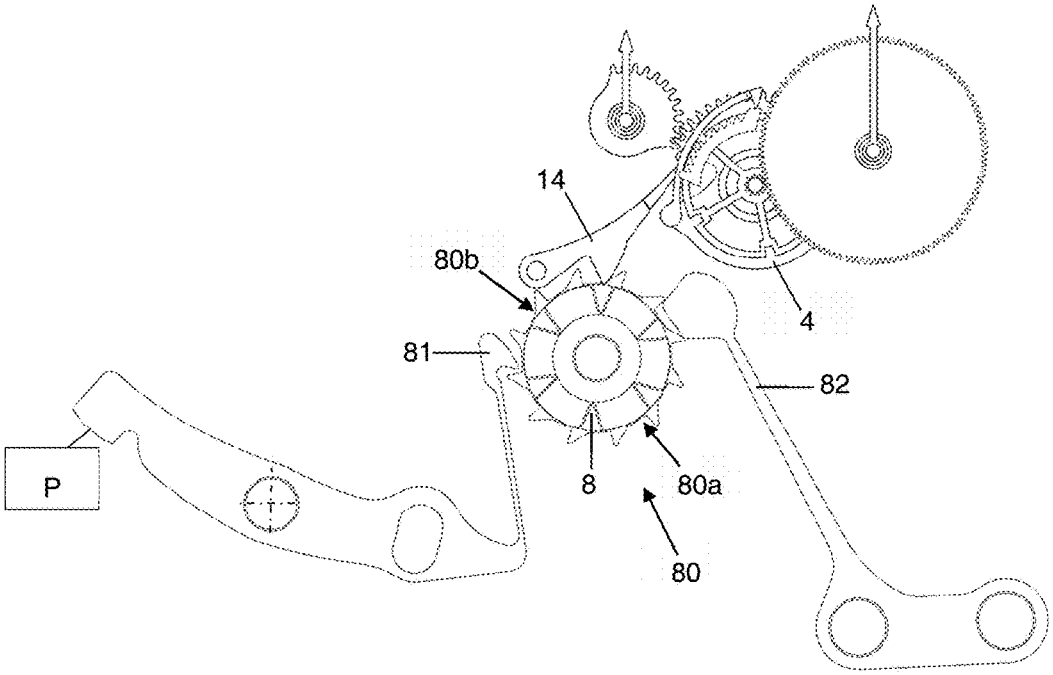
Figure 5:
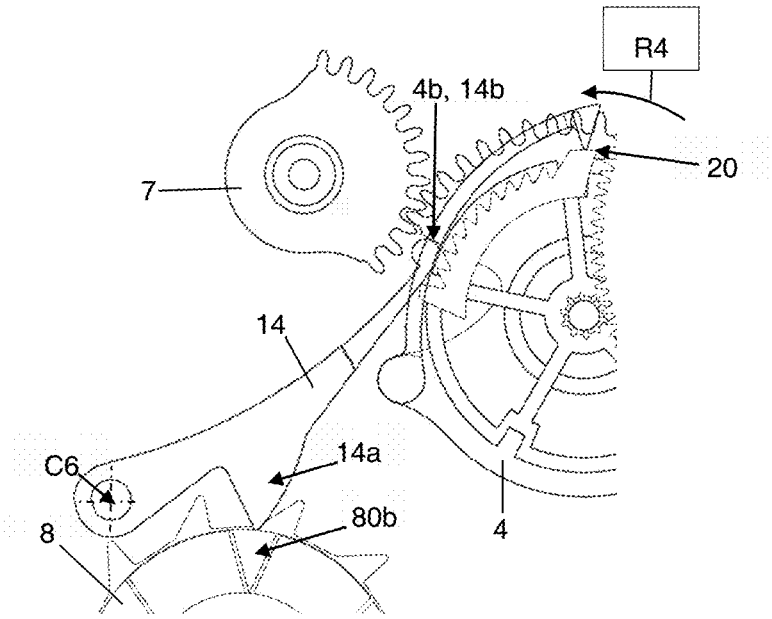

As represented in FIG. 4, the control system 80 includes a lever 14 and a control member 8, notably a control member including a binary profile 80*b*.

The control member is for example a column wheel. The control system further includes a control lever 81 connected to a pushbutton P and an indexing jumper 82 of the column wheel. The latter is adapted to be actuated and driven one angular step by the pushbutton P via the control lever 81 acting on a ratchet toothset 80*a* of the column wheel. The column wheel 8 and the pushbutton P are preferably also adapted to actuate starting and stopping of the counting system of the chronograph module. The chronograph and the counting device 100 can therefore be driven in perfect synchronism.

The lever and the control member are adapted to cooperate together so that the control system has:

- the first or non-counting state corresponding to a predefined position of the support 4 relative to the frame in which the pawl 3 cooperates with the second surface 20, notably rests on the second surface, and
- the second or counting state allowing any position of the support 4 relative to the frame and in which the pawl 3 cooperates obstacle-wise with one of the second recesses.

Accordingly, when the chronograph module is stopped, and therefore when the rotation of the mobiles 5 and 6 is stopped, the counting device 100 is activated by way of the control system. The control system advantageously makes it possible to control the chronograph module and the counting device simultaneously.

The binary profile 80*b* of the column wheel makes it possible to define the state or the position of the lever 14.

When the counting device 100 is inoperative, i.e. in the non-counting state, the second end 14*a* or the follower 14*a* of the lever 14 is pressed against one of the columns of the profile 80*b* of the column wheel 8. In this configuration, a flank 4*b* of the support 4 is pressed against the first end 14*b* or the head 14*b* of the lever 14. This head determines a predefined position of the support represented in FIGS. 2 and 4 to 6. The lever 14 therefore opposes movement of the support liable to be generated by the return torque of the spring R4 represented diagrammatically in FIGS. 5 and 6.

Figure 7:
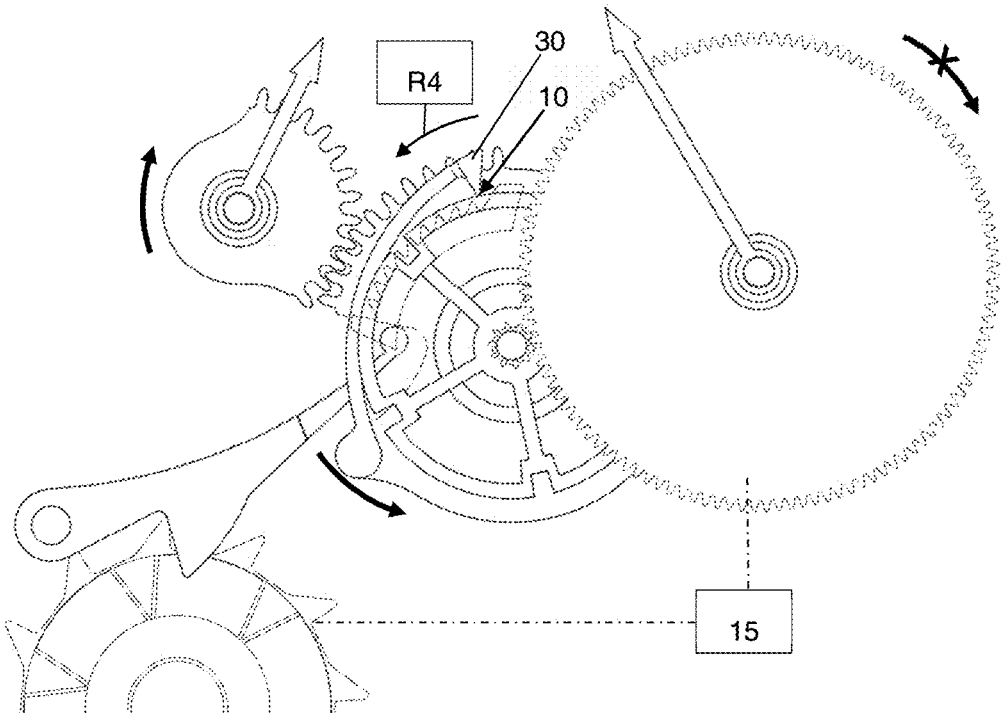
Figure 8:
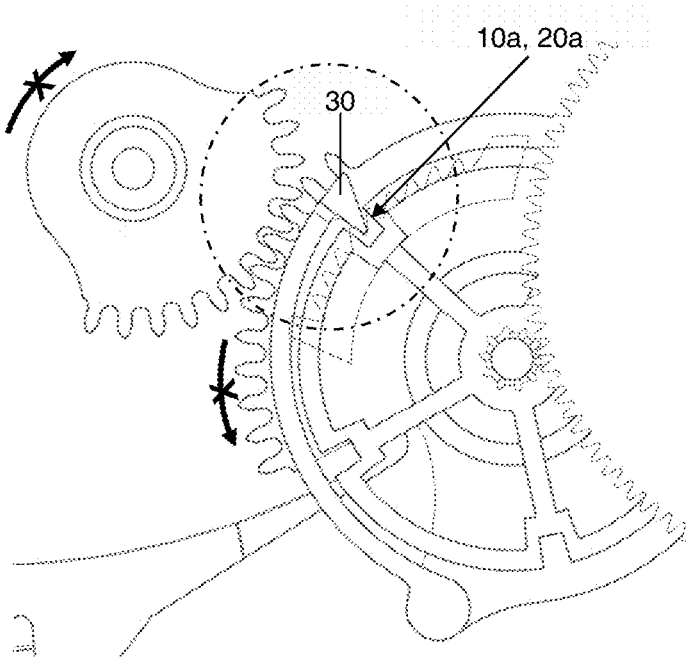
Figure 9:
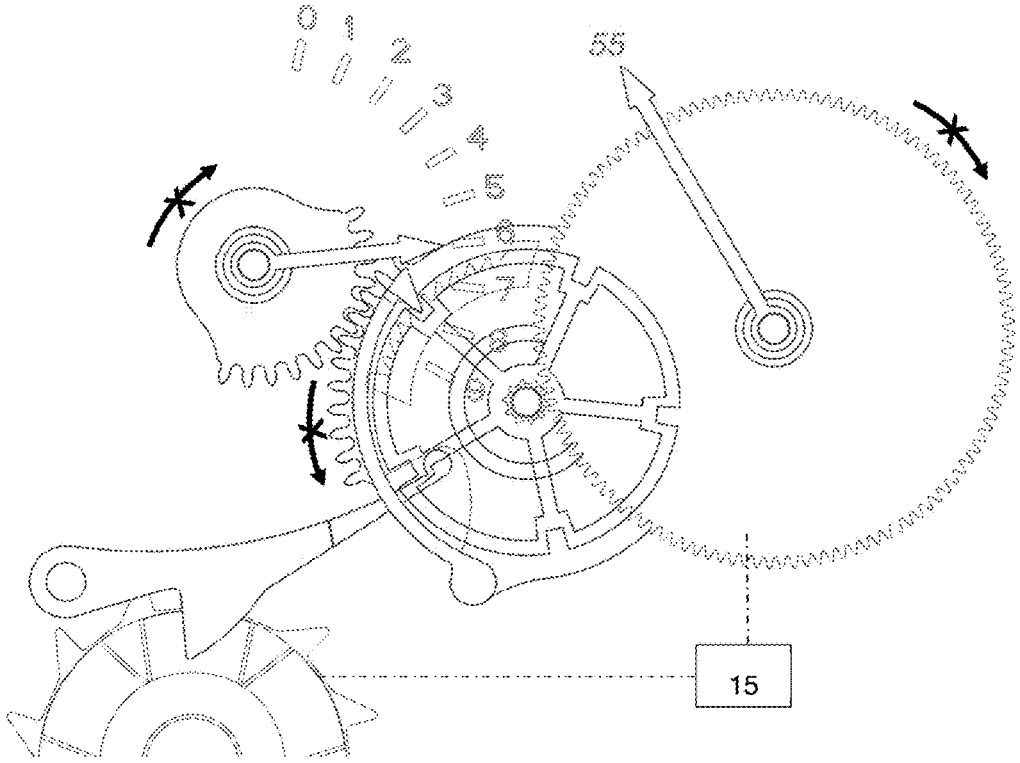

When the counting device 100 is functioning, i.e. in the counting state, the second end 14*a* or the follower 14*a* of the lever 14 is no longer pressed against one of the columns of the profile 80*b* of the column wheel 8. In this configuration, the head 14*b* of the lever is retracted by the flank 4*b* of the support 4 because of the effect of the spring R4, as represented in FIGS. 7 to 9.

The operation of the first embodiment of the device 100 described above is explained in more detail next with reference to FIGS. 6 to 9.

Figure 6:
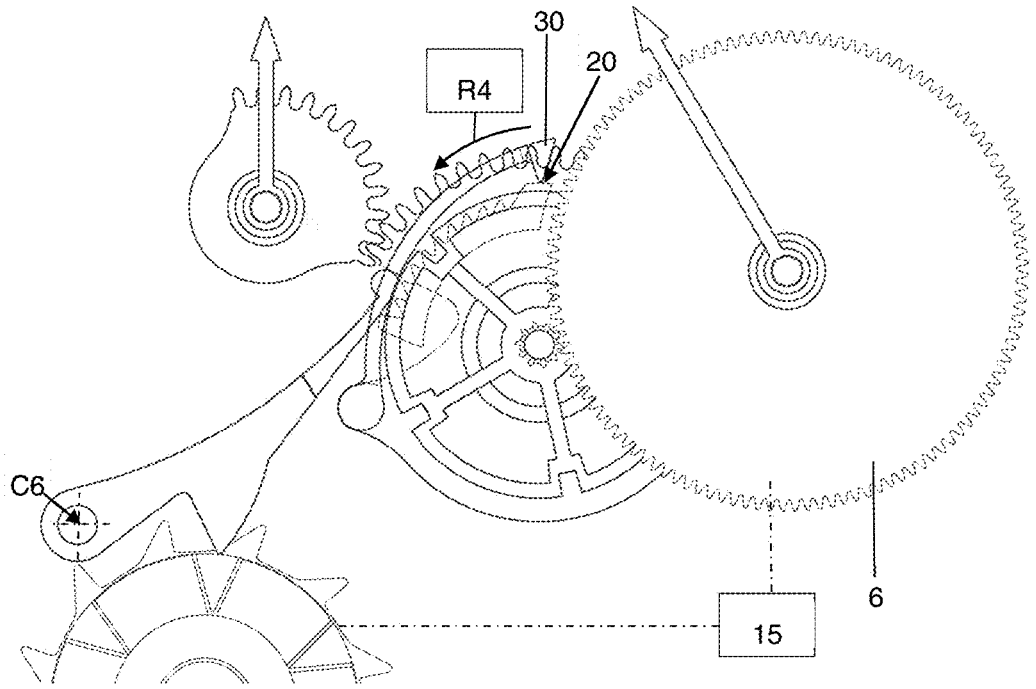

It is assumed that the device is initially in the configuration shown in FIG. 6, i.e. that the chronograph module is functioning and displaying evolving time information, with the chronograph pointers, notably the seconds pointer A2, turning.

FIG. 6 shows the device 100 just before actuation of the pushbutton P. In this configuration, the beak 30 of the pawl 3 is bearing against the second abutment surface 20 so that the beak 30 of the pawl 3 is out of the reach of the outside periphery 10 of the first cam 1. The latter is therefore free to turn at the rate of the gear 5 because of the effect of the chronograph counting system and notably the mobile 6. The fractions of a second display device is therefore inoperative when the chronograph mechanism is tripped.

As represented in FIG. 7, rotation of the column wheel 8 because of the effect of the pushbutton P induces rotation of the lever 14 and the support 4 because of the effect of the spring R4. In fact, in this configuration, the head 14*b* of the lever is able to retract because the lever 14, notably the end 14*a*, is no longer bearing against one of the columns 80*b* of the column wheel 8. It follows that the support 4 is urged toward its rest position by the spring R4. The column wheel 8 also simultaneously stops the rotation of the mobiles 5 and 6 because of the effect of a clutch and/or brake mechanism 15 represented diagrammatically in FIGS. 6 and 7.

When the support 4 moves, the beak 30 of the pawl 3 leaves the second abutment surface 20 and comes to bear against the first surface 10 of the cam 1 because of the effect of the spring R3. The beak moves on the first surface until it encounters a first recess 10*a* into which it is pushed by the spring R3. The recesses 10*a* and 20*a* are sized so that the recess 10*a* can be superposed on one and only one recess 20*a*. Accordingly, as soon as the beak 30 of the pawl 3 is facing a recess 10*a* it is inserted into a recess 20*a*, as represented in FIG. 8, and immobilizes the support, the recesses 20*a* being fixed relative to the frame.

When the support moves, the tenths of a second indicator A1 also moves until it reaches a position defined by the second recess 20*a* in which the beak 30 is inserted. In this state, represented in FIG. 9, the device 100 displays the memorized or chronometered time information to the nearest tenth of a second. In the FIG. 9 example, the device is displaying 55 seconds and 6 tenths of a second.

Pressing the pushbutton P again rotates the column wheel to position the latter in the state illustrated in FIG. 6. The column wheel acts on the lever 14 to reposition the latter in its position shown in FIG. 6. This movement of the lever causes an action of the head of the lever against the support to reposition the latter in its position shown in FIG. 6 against the action of the return spring R4. During this step, the beak 30 of the pawl is extracted from the recesses, moved against a cylindrical portion of the first surface and positioned in contact with the second abutment surface. During this step, the movement of the support also involves the movement of the indicator A1, which returns to its position shown in FIG. 6. Pressing the pushbutton again in this way can retrip the chronograph module via the mechanism 15.

When the chronograph module is tripped, the passage from one first recess 10*a* to another, consecutive first recess 10*a* relative to the beak 30 of the pawl 3 takes one second. On activation of the device for displaying tenths of a second, the beak 30 of the pawl 3 lodges in one of the second recesses 20*a* thanks to the presence of one of the five recesses 10*a* on the first surface of the first cam 1. The device 100 therefore has the particular feature of including two distinct cams 1 and 2 each of which is adapted to cooperate with the pawl fixed to the mobile support 4 forming a rack, for example.

In a second embodiment that is not represented the counting device does not include any second recesses. The support that is moved by the action of the return spring is therefore stopped by the cooperation of the beak of the pawl with a first recess, in particular by the cooperation by contact of the pawl beak with a flank of a first recess. In an embodiment of this kind, it is essential that the braking torque of the seconds mobile is sufficient to overcome the torque produced by the return spring of the support and by the return spring of the pawl. Moreover, the backlash in the toothsets of the gear trains 5 and 6 may be minimized in order to limit beating of the indicator A1 in a state displaying memorized time information.

With an embodiment of the above kind, the tenths of a second indicator A1 does not take only ten predefined positions as in the first embodiment but is able to assume any position on the limb, in particular a position between two time indications.

The embodiments described above can of course be generalized to any type of display adapted to indicate on demand a fraction of any time indication or any indication derived from the time that has been memorized. Very specifically, depending on the frequency chosen for the oscillator of the basic movement, a device 100 of this kind could for example display hundredths of a second.

The number j of first recesses 10*a* of the first cam 1 is given by the speed v (in revolutions per minute) at which the gear 5 rotates. The display precision p (in seconds) is given by the number i of second recesses 20*a* of the second cam 2, which is chosen as a function of the frequency f (in hertz) of the oscillator. The table below gives a few examples, including the first embodiment described above (*).

| p | f | v | i | j |
|---|---|---|---|---|
| 0.125 | 4 | 12 | 8 | 5 |
| * 0.1 | 5 | 12 | 10 | 5 |
| 0.1 | 5 | 15 | 10 | 4 |
| 0.1 | 5 | 20 | 10 | 3 |
| 0.01 | 50 | 120 | 100 | 5 |
| 0.01 | 50 | 150 | 100 | 4 |
| 0.01 | 50 | 200 | 100 | 3 |

Figure 10:
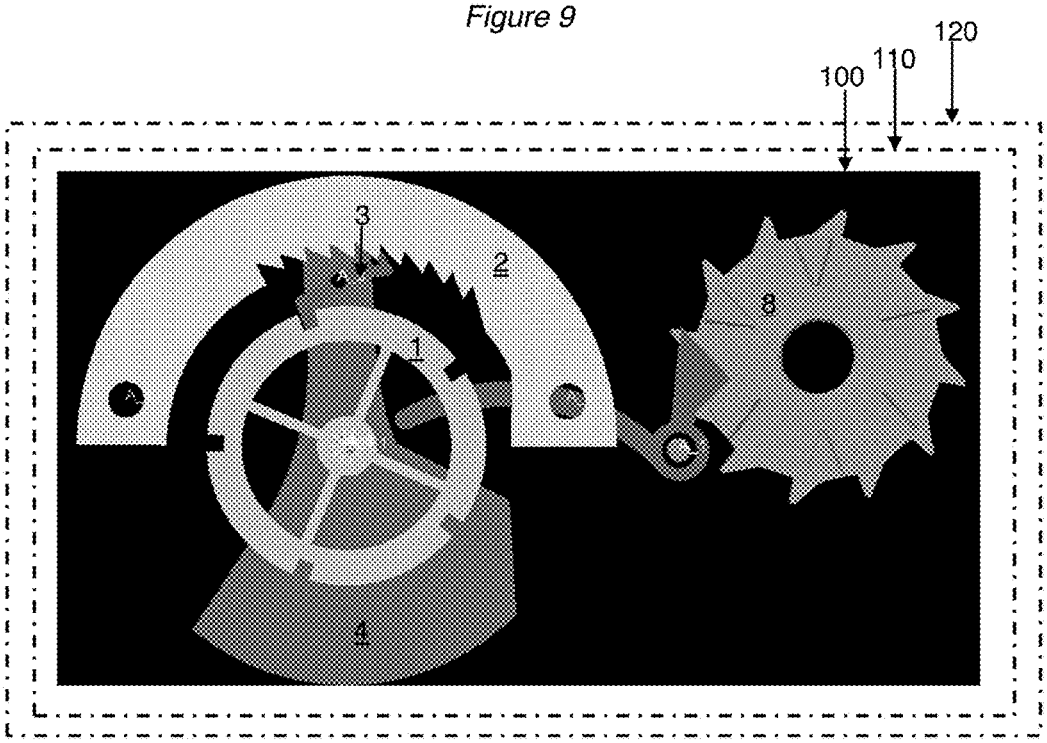
FIG. 10 represents a second embodiment of a counting device according to the invention and a third embodiment of a timepiece according to the invention.

In the first embodiment, the beak 30 of the pawl 3 is staggered over two distinct levels corresponding to the respective levels of the first and second cams 1, 2. In a third embodiment illustrated by FIG. 10 the cams 1 and 2 could be coplanar. To this end, the pawls 3 could take the form of a pivoting lever having two distinct beaks on respective opposite sides of its pivot axis C5 on the support 4. Each of the beaks of the pawl would then be specifically designed to cooperate with one or the other of the first and second cams 1 and 2.

The pawl 3 could preferably be in one piece with the support 4 and connected to the rest of the support by flexible arms.

In the first and third embodiments, the counting device includes two distinct cams each of which is designed to cooperate with the same pawl. The first cam is kinematically linked to the gear train bearing the time information whereas the second cam is fixed relative to the frame of the timepiece.

In the various embodiments described, the first cam is mobile in rotation and takes the form of a wheel. However, the first cam could be mobile with some other movement, for example in translation, and could have another shape.

The device makes it possible to count a number of time unit fractions by counting a number of movement unit fractions of a mobile member. It is in fact possible to consider the counting of a number of movement unit fractions of a mobile member to count a number of time unit fractions by assuming a correlation between the two measurements, in particular if the mobile member moves at a constant speed.

In the present application, "fraction" is meant in the broad mathematical sense with the result that the fraction of a unit may be greater than unity. Alternatively, a fraction of a unit is a part of the unit and therefore less than unity.

The invention further relates to a method of operating a counting device 100 described above or a movement 110 described above or a timepiece 120 described above.

The method includes, in a first phase of operation, the following steps:

- immobilizing the first cam 1;
- retracting a lever 14 or an abutment immobilizing the support 4 in a predetermined position;
- moving the support 4 relative to the frame from a first predefined position to a rest position until the pawl abuts a first recess 10*a*, for example abuts against a flank of the first recess or abuts against a flank of a second recess 20*a*.

The method may include, in a second phase of operation, the following step:

- action on the lever 14 or on the abutment so as to return the support to its first predefined position.

This action may be brought about thanks to the energy of an action of a user on the device, notably the energy of a user pressing the pushbutton.

The first phase and/or the second phase is advantageously triggered by an action on the control system, notably pressing the pushbutton.

The invention claimed is:

1. A device for counting a number of time unit fractions or a number of movement unit fractions of a mobile member, the device comprising:

a first cam having a first surface, the first surface being a cam surface, the first cam being configured to be driven by the mobile member;

a second surface, the second surface being an abutment surface;

a mobile support urged by a first spring;

a mobile pawl mounted on the mobile support and urged by a second spring toward the first surface, the pawl being adapted to cooperate with one or the other of the first and second surfaces according to the position of the mobile support; and a control system adapted, in a first non-counting state of the control system, to maintain the mobile support in a first position wherein the mobile pawl cooperates with the second surface, and, in a second counting state of the control system, to allow the movement of the mobile support, wherein, in the movement of the mobile support urged by the first spring, the mobile pawl cooperates with the first surface.

2. The device as claimed in claim 1, wherein the first surface of the cam includes a plurality of first recesses adapted to cooperate with the pawl in the counting state of the control system.

3. The device as claimed in claim 2, wherein the first recesses are adapted, in the counting state of the control system, to cooperate with the mobile pawl to immobilize the mobile support.

4. The device as claimed in claim 3, wherein the first recesses are adapted, in the counting state of the control system, to allow the immobilization of the mobile support through the cooperation by contact of the pawl with a second recess aligned with one of the first recesses.

5. The device as claimed in claim 1, comprising a second cam including a plurality of second recesses adapted to cooperate with the pawl in the counting state of the control system.

6. The device as claimed in claim 5, wherein the second cam includes a toothset, the teeth of which define the second recesses.

7. The device as claimed in claim 6, wherein at least one selected from the group consisting of (i) the first cam and the toothset are coaxial, (ii) the first surface is an external surface of the first cam and the radius of the first surface is greater than or equal to the total outside radius of the toothset, and (iii) the first surface is an inside surface of the first cam and the inside radius of the first surface is less than or equal to the total inside radius of the toothset.

8. The device as claimed in claim 6, wherein the angle subtended by a first recess is greater than or equal to the angle subtended by a second recess defined by the pitch of the toothset.

9. The device as claimed in claim 5, wherein the second cam includes the second surface.

10. The device as claimed in claim 9, wherein the second surface is circular or substantially circular.

11. The device as claimed in claim 5, wherein the second recesses are adapted to cooperate through contact with the pawl in the counting state of the control system.

12. The device as claimed in claim 1, wherein the first cam is a wheel pivoted on frame.

13. The device as claimed in claim 1, wherein the mobile support pivots on a frame.

14. The device as claimed in claim 13, wherein the mobile support pivots on the frame coaxially with the first cam.

15. The device as claimed in claim 1, wherein at least one of (i) the first surface and the second surface are coaxial, (ii) the first surface is an outside surface of the first cam and the radius of the first surface is less than the outside radius of the second surface, and (iii) the first surface is an inside surface of the first cam and the inside radius of the first surface is greater than the inside radius of the second surface.

16. The device as claimed in claim 1, wherein the control system includes a lever and a control member, the lever and the control member being adapted to cooperate with one another in order for the lever to be in the first non-counting state corresponding to a predefined position of the support in which the pawl cooperates with the second surface and the second counting state allowing any position of the support in which the pawl cooperates obstacle-wise with one of the first or second recesses.

17. The device as claimed in claim 1, including a display member kinematically linked to the support.

18. A timepiece movement including a device as claimed in claim 1.

19. A timepiece including a device as claimed in claim 1.

20. The device as claimed in claim 1, wherein the mobile member is mobile relative to a frame, the first surface is fixed relative to the mobile member, the second surface is fixed relative to the first surface.

21. The device as claimed in claim 1, wherein the mobile member is mobile relative to a frame, the first surface is fixed relative to the mobile member, the second surface is fixed relative to the frame.

22. A The device as claimed in claim 1, wherein the first surface of the cam includes a plurality of first recesses adapted to cooperate with the pawl in the counting state of the control system and a second cam including a plurality of second recesses adapted to cooperate with the pawl in the counting state of the control system.

23. The device as claimed in claim 22, wherein the second cam includes a toothset, the teeth of which define the second recesses, and the first recesses are adapted, in the counting state of the control system, to allow the immobilization of the mobile support through the cooperation by contact of the pawl with one of the second recesses aligned with one of the first recesses.

* * * * *